US006117379A

United States Patent [19]

Haynes et al.

[11] Patent Number: 6,117,379

[45] Date of Patent: Sep. 12, 2000

[54] METHOD AND APPARATUS FOR IMPROVED QUENCHING OF NONWOVEN FILAMENTS

[75] Inventors: Bryan David Haynes, Cumming; Jark C. Lau, Roswell, both of Ga.; Chad Michael Freese, Neenah, Wis.

[73] Assignee: Kimberly-Clark Worldwide, Inc., Neenah, Wis.

[21] Appl. No.: 09/124,536

[22] Filed: Jul. 29, 1998

[51] Int. Cl.[7] ..... B29C 71/00

[52] U.S. Cl. ..... 264/237; 264/211.21; 425/464

[58] Field of Search ..... 425/66, 72, 83, 425/725, 379 S, 382.2; 264/210.8, 177 P, 211.14, 237, 176 F, 711, 14, 19, 211.15, 211.16, 211.17, 211.21

[56] References Cited

U.S. PATENT DOCUMENTS

| | | | |
|---|---|---|---|
| 3,070,839 | 1/1963 | Thompson | 18/8 |
| 3,338,992 | 8/1967 | Kinney . | |
| 3,341,394 | 9/1967 | Kinney | 161/72 |
| 3,460,200 | 8/1969 | Zaitsev et al. | 18/8 |
| 3,502,538 | 3/1970 | Petersen | 161/150 |
| 3,502,763 | 3/1970 | Hartmann . | |
| 3,542,615 | 11/1970 | Dobo et al. | 156/181 |
| 3,692,618 | 9/1972 | Dorschner et al. . | |
| 3,705,227 | 12/1972 | Fintel et al. | 264/176 |
| 3,802,817 | 4/1974 | Matsuki et al. . | |
| 3,874,886 | 4/1975 | Levecque et al. | 106/50 |
| 4,057,910 | 11/1977 | Sachleben, Sr. et al. | 34/227 |
| 4,334,340 | 6/1982 | Reba | 19/299 |
| 4,340,563 | 7/1982 | Appel et al. | 264/518 |
| 4,492,557 | 1/1985 | Ray et al. . | |
| 4,529,368 | 7/1985 | Makansi . | |
| 4,712,988 | 12/1987 | Broaddus et al. . | |
| 4,943,220 | 7/1990 | Fourne . | |
| 5,108,820 | 4/1992 | Kaneko et al. | 428/198 |
| 5,108,827 | 4/1992 | Gessner | 428/219 |
| 5,178,931 | 1/1993 | Perkins et al. | 428/198 |
| 5,219,582 | 6/1993 | Anderson et al. . | |
| 5,336,552 | 8/1994 | Strack et al. | 428/224 |
| 5,382,400 | 1/1995 | Pike et al. | 264/168 |
| 5,545,371 | 8/1996 | Lu . | |
| 5,650,112 | 7/1997 | Zikeli et al. . | |
| 5,766,646 | 6/1998 | Geus et al. | 425/72.2 |

FOREIGN PATENT DOCUMENTS

| | | | |
|---|---|---|---|
| 1278684 | 9/1968 | Germany . | |
| 46-34925 | 10/1971 | Japan . | |
| 46-37773 | 11/1971 | Japan . | |
| 1500701 | 8/1989 | U.S.S.R. . | |
| 89/02420 | 3/1989 | WIPO | C03B 37/10 |
| 98/58110 | 12/1998 | WIPO | D04H 3/16 |

OTHER PUBLICATIONS

Manson, John A. and Sperling, Leslie H.: *Polymer Blends and Composites,* Plenum Press, New York, ISBN 0–306–30831–2, pp. 273–277 (1976).

M. Gundappa and T.E. Diller: The Effects of Free–Stream Turbulence and Flow Pulsation on Heat Transfer From a Cylinder in Crossflow, *Journal of Heat Transfer,* 766/vol. 113, Aug. 1991.

C.J. Hoogendoorn: The Effect of Turbulence on Heat Transfer at a Stagnation Point, *Mass Transfer,* vol. 20, pp. 1333–1338, Pergamon Press 1977.

*Primary Examiner*—Merrick Dixon

*Attorney, Agent, or Firm*—Pauley Peterson Kinne & Fejer

[57] ABSTRACT

A method and apparatus for improved quenching of nonwoven filaments utilizing a turbulence inducing bar arrangement disposed in a stream of quenching gas between the quenching gas supply apparatus and the group of filaments being extruded. The bar arrangement increases the turbulence of the quenching gas so that the gas applied to the filament group has a turbulence intensity of at least about 5%. The turbulent quenching gas penetrates the interior of the filament bundle to provide more efficient removal of heat.

25 Claims, 4 Drawing Sheets

METHOD AND APPARATUS FOR IMPROVED QUENCHING OF NONWOVEN FILAMENTS

FIELD OF THE INVENTION

This invention is directed to a method and apparatus for improving the quenching efficiency of nonwoven filaments after they are extruded from a spinnerette. More specifically, the invention is directed to a method and apparatus for inducing turbulence into air streams used to cool the filaments, thereby improving the cooling efficiency of the air.

BACKGROUND OF THE INVENTION

The quenching of nonwoven filaments using air and other fluids is known in the art. U.S. Pat. No. 3,070,839, issued to Thompson, discloses using a stream of air to quench melt spun filaments. A screen is positioned between the air supply and the filaments to diffuse the air stream and minimize its turbulence. The cooling is accomplished in zones ranging from relatively low air flow near the spinnerette to successively greater air flows at distances further from the spinnerette. This technique allegedly reduces the breakage of filaments during cooling.

U.S. Pat. No. 4,492,557, issued to Ray et al., discloses the use of diffusers to reduce turbulence of cooling gas. The turbulence-reducing diffusers disclosed include screens, porous foam, perforated metal plates, sintered metal, metallic wool, felt, and sandwiches of meshed screens. A varied gas distribution pattern can be achieved by providing a diffuser having regions of different porosity.

U.S. Pat. No. 4,712,988, issued to Broaddus et al., discloses an apparatus for radially quenching melt spun filaments. A quenching chamber is provided with a foraminous distribution cylinder between the filaments and the gas supply. Quenching gas enters the cylinder from all sides, and is diffused by the foraminous cylinder. The foraminous openings are sized to control the velocity of the quenching gas entering the filaments.

The use of flow control devices, namely gas diffusers, has generally been for the purpose of reducing gas velocity and turbulence. These techniques distribute and diffuse the gas flow and are intended to introduce a more tranquil, laminar flow having less tendency to disturb or break the filaments. However, the nature of laminar flow is such that when quenching gas (e.g., air) contacts the filaments, the rates of heat transfer and quenching are relatively lower. There is a need or desire in the nonwoven industry for a quenching technique which optimizes cooling efficiency as well as evenly distributing the gas.

SUMMARY OF THE INVENTION

The present invention is directed to a method and apparatus which improves the quenching efficiency of nonwoven filaments exiting from a spinnerette, compared to prior art techniques. The method and apparatus increase the turbulence of a quenching gas stream in a controlled manner, so as to increase the heat transfer rate without unduly disturbing or breaking the filaments. This is in contrast to prior art techniques which distributed the gas stream at reduced turbulent levels. The distributed, turbulent gas flow improves quenching by achieving better heat transfer between the filaments and gas, and better penetration of filament groups and bundles by the gas flow, so that the inner layers of filaments are more easily and quickly reached by the gas.

In accordance with the invention, a turbulence inducing bar arrangement is positioned in the quench gas stream on the side of a spinnerette used to extrude nonwoven polymer filaments, and may be placed downstream of devices typically used to evenly distribute the gas flow. The bar arrangement may include a plurality of spaced, substantially parallel bars, for instance, or may involve another arrangement. Quench gas is directed through the turbulence-inducing bar arrangement toward the molten filaments leaving the spinnerette. As the quench gas stream passes through the bar arrangement, it is split into a plurality of smaller streams which interfere with each other to cause turbulence.

The turbulence inducing bar arrangement operates to distribute the quench gas along the filaments as well as to cause turbulence. In order for turbulence to occur, the quench gas need only be supplied at a conventional flow rate and velocity. The bar arrangement causes turbulence without requiring increased flow velocity, thereby minimizing disturbance or breakage of the filaments being quenched. An objective is to attain as much gas penetration of the filament group as possible, without damaging the filaments.

With the foregoing in mind, it is a feature and advantage of the invention to provide an efficient method for quenching a filament group or bundle which utilizes a distributed stream or streams of turbulent quenching gas.

It is also a feature and advantage of the invention to provide an apparatus which increases the turbulence of quenching gas to cause more efficient cooling of a group or bundle of filaments being extruded from a spinnerette.

The foregoing and other features and advantages will become further apparent from the following detailed description of the presently preferred embodiments, read in conjunction with the accompanying drawings. The detailed description and drawings are intended to be illustrative rather than limiting, the scope of the invention being defined by the appended claims and equivalents thereof.

DEFINITIONS

Figure 2:
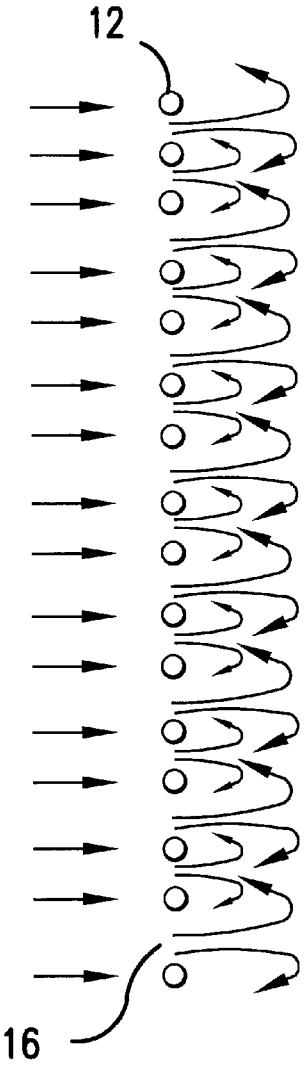
FIG. 2 schematically illustrates how the turbulence-inducing bar arrangement converts one or more streams of laminar gas flow into turbulent streams, by dividing the initial stream or streams into smaller streams which interfere and collide with one another.

As used herein, the term "nonwoven fabric or web" means a web having a structure of individual fibers or threads which are interlaid, but not in a regular or identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91.)

As used herein, the term "microfibers" means small diameter fibers having an average diameter not greater than about 75 microns, for example, having an average diameter of from about 5 microns to about 50 microns, or more particularly, microfibers may have an average diameter of from about 10 microns to about 20 microns. Another frequently used expression of fiber diameter is denier, which is defined as grams per 9000 meters of a fiber and may be calculated as fiber diameter in microns squared, multiplied by the density in grams/cc, multiplied by 0.00707. A lower denier indicates a finer fiber and a higher denier indicates a thicker or heavier fiber. For example, the diameter of a polypropylene fiber given as 15 microns may be converted to denier by squaring, multiplying the result by 0.89 g/cc and multiplying by 0.00707. Thus, a 15 micron polypropylene fiber has a denier of about 1.42 ($15^2 \times \mathbf{0.89} \times \mathbf{0.00707} = \mathbf{1.415}$). Outside the United States the unit of measurement is more commonly the "tex", which is defined as the grams per kilometer of fiber. Tex may be calculated as denier/9.

As used herein, the term "spunbonded fibers" refers to small diameter fibers which are formed by extruding molten thermoplastic material as filaments from a plurality of fine, usually circular capillaries of a spinnerette with the diameter of the extruded filaments then being rapidly reduced as by, for example, in U.S. Pat. No. 4,340,563 to Appel et al., and U.S. Pat. No. 3,692,618 to Dorschner et al., U.S. Pat. No 3,802,817 to Matsuki et al., U.S. Pat. Nos. 3,338,992 and 3,341,394 to Kinney, U.S. Pat. No. 3,502,763 to Hartman, U.S. Pat. No. 3,502,538 to Petersen, and U.S. Pat. No. 3,542,615 to Dobo et al., each of which is incorporated herein in its entirety by reference. Spunbond fibers are generally not tacky on the surface when they enter the draw unit, or when they are deposited onto a collecting surface. Spunbond fibers are quenched and generally continuous and have average diameters larger than about 7 microns, more particularly, between about 10 and 20 microns.

As used herein, the term "polymer" generally includes but is not limited to, homopolymers, copolymers, such as for example, block, graft, random and alternating copolymers, terpolymers, etc., and blends and modifications thereof. Furthermore, unless otherwise specifically limited, the term "polymer" shall include all possible geometrical configurations of the material. These configurations include, but are not limited to isotactic, syndiotactic and random symmetries, and include crystalline polymers as well as semi-crystalline polymers, amorphous polymers and waxes.

As used herein, the term "monocomponent" fiber refers to a fiber formed from one or more extruders using only one polymer. This is not meant to exclude fibers formed from one polymer to which small amounts of additives have been added for color, anti-static properties, lubrication, hydrophilicity, etc. These additives, e.g., titanium dioxide for color, are generally present in an amount less than 5 weight percent and more typically about 2 weight percent.

As used herein, the term "conjugate fibers" refers to fibers which have been formed from at least two polymers extruded from separate extruders but spun together to form one fiber. Conjugate fibers are also sometimes referred to as multicomponent or bicomponent fibers. The polymers are usually different from each other though conjugate fibers may be monocomponent fibers. The polymers are arranged in substantially constantly positioned distinct zones across the cross section of the conjugate fibers and extend continuously along the length of the conjugate fibers. The configuration of such a conjugate fiber may be, for example, a sheath/core arrangement wherein one polymer is surrounded by another or may be a side-by-side arrangement or an "islands-in-the-sea" arrangement. Conjugate fibers are taught in U.S. Pat. No. 5,108,820 to Kaneko et al., U.S. Pat. No. 5,336,552 to Strack et al., and U.S. Pat. No. 5,382,400 to Pike et al., each of which is incorporated herein in its entirety by reference. For two component fibers, the polymers may be present in ratios of 75/25, 50/50, 25/75 or any other desired ratios.

As used herein, the term "biconstituent fibers" refers to fibers which have been formed from at least two polymers extruded from the same extruder as a blend. The term "blend" is defined below. Biconstituent fibers do not have the various polymer components arranged in relatively constantly positioned distinct zones across the cross-sectional area of the fiber and the various polymers are usually not continuous along the entire length of the fiber, instead usually forming fibrils or protofibrils which start and end at random. Biconstituent fibers are sometimes also referred to as multiconstituent fibers. Fibers of this general type are discussed in, for example, U.S. Pat. No. 5,108,827 to Gessner. Bicomponent and biconstituent fibers are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at pages 273 through 277.

As used herein, the term "blend" as applied to polymers, means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

As used herein, the term "heteroconstituent nonwoven web" (or web layer) refers to a nonwoven web or layer having a mixture of at least two filament or fiber types A and B which differ from each other in terms of polymer contents, fiber size ranges, fiber shapes, pigment or additive loadings, crimp levels, and/or other compositional and physical properties.

As used herein, the term "multilayered nonwoven web" refers to a nonwoven web having at least two filament or fiber types arranged in two or more different layers. The filaments or fibers in the different layers may differ from each other in terms of overall polymer contents, fiber size ranges, fiber shapes, pigment or additive loadings, crimp levels, and/or other compositional and physical properties. The individual layers in a multilayered nonwoven web may, but need not be, heteroconstituent nonwoven web layers as described above.

As used herein, the term "turbulence inducing bar arrangement" refers to an arrangement of bars which are large enough, and far enough apart, to cause a wake-induced increase in turbulence of a gas which passes between the bars. A more detailed description is provided below. The bars are larger and further apart than the elements in mesh screens and similar devices which reduce turbulence instead of increasing it.

DETAILED DESCRIPTION OF THE PRESENTLY PREFERRED EMBODIMENTS

In order to achieve a uniform, well-distributed gas stream, the gas used to quench nonwoven filaments is typically passed through perforated plates or screens, and a honeycomb. These devices employ narrow mesh openings to generate flow having low turbulence intensity, often on the order of 2–3% for the flow velocities typical of quench applications. Gas having such low turbulence intensity provides inefficient and poor convective heat transfer, which is the primary mechanism of heat transfer between nonwoven filaments and quenching gas. For instance, gas having low turbulence does not sufficiently penetrate a group or bundle of molten filaments to carry heat away from the inner filaments in the group or bundle.

Figure 1:
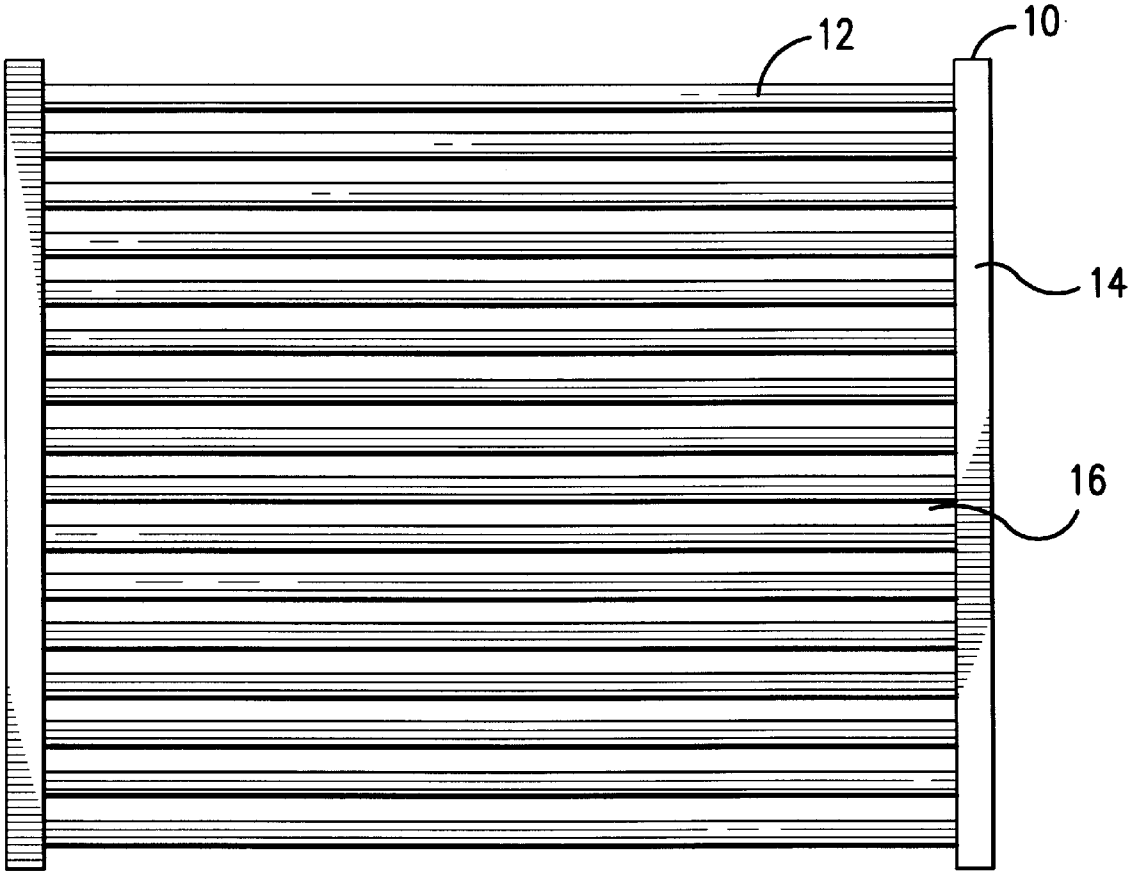
FIG. 1 illustrates a turbulence-inducing bar arrangement useful in the method and apparatus of the invention.

The present invention provides an apparatus and method which can be used to increase the turbulence of quench air, at conventional velocity, which has been evenly distributed by conventional apparatus as described above. Referring to FIG. 1, a turbulence-inducing bar arrangement 10 includes a plurality of bars 12 supported by two side bars 14. The bars 12 are separated from each other by open spaces 16. The bars 12 are preferably substantially parallel to each other, and are preferably positioned substantially perpendicular to the direction of travel of nonwoven filaments being quenched.

The planar area occupied by the bar arrangement 10 can be defined as including the planar area occupied by the bars 12 plus the planar areas occupied by open spaces 16 between the bars, and not including the area occupied by support bars 14. The bars 12 should occupy about 20–80% of the planar area occupied by the bar arrangement 10, preferably about 30–70% of the planar area occupied by bar arrangement 10, most preferably about 40–60% of the planar area occupied by bar arrangement 10. Similarly, the open spaces 16 should occupy about 20–80% of the planar area occupied by bar arrangement 10, preferably about 30–70%, most preferably about 40–60%. If the percentage area occupied by the bars 12 is too low, the bar arrangement 10 will have little or no effect on converting the flow of supply gas (e.g., air) to turbulent from laminar. If the percentage area occupied by the bars 12 is too large, leaving the open spaces 16 too small, the bar arrangement 10 may behave like diffusing screens of the prior art which reduce turbulence instead of increasing it.

The sizing and spacing of bars 12 should be such that the quenching gas is converted to turbulent flow having a turbulence intensity greater than about 5%, preferably greater than about 10%, more preferably greater than about 20%, as measured by the test procedure described below. The general operation of bars 12 is shown schematically in FIG. 2. The parallel arrows illustrate the substantially laminar flow of gas from a source toward the bars 12. The semi-circular, vortex-shaped arrows represent wakes illustrative of a more turbulent flow of quenching gas, after the flow has passed through the bars. The interference of the bars 12 in the flow path causes the quenching gas to pass through the openings 16, and splits the flow into a plurality of smaller streams. The smaller streams are directed at higher average velocity downstream from the bars than the main gas stream approaching the bars. The smaller streams are also directed at different angles, resulting in multiple wake formation downstream from the bars. This multiple wake formation causes the overall flow to become much more turbulent.

The size of the bars 12 should be large enough to split and redirect the flow of quench gas in the manner shown in FIG. 2, so as to cause sustained turbulence. If the bars 12 are too small, they will behave like a mesh screen which either reduces or fails to significantly increase the turbulence. The bars 12 may have an average diameter of about 0.125–1.00 inch, preferably about 0.25–0.75 inch, more preferably about 0.40–0.60 inch. Similarly, the openings 16 between the bars may have an average width of about 0.125–1.00 inch, preferably about 0.25–0.75 inch, more preferably about 0.40–0.60 inch. The bars 12 (and the overall bar arrangement 10) may be constructed of wood, metal, rigid plastic, other materials having suitable structural integrity, and combinations of the foregoing materials.

The number and length of bars 12 in the turbulence-inducing bar arrangement 10 will vary depending on the dimensions of the quench gas source whose flow is being modified, and of the filament bundle to which the modified flow is being directed. The bar arrangement 10 should be sized to interfere with substantially all of the quench gas which flows from the gas source to the filament bundle. If the bar arrangement 10 is positioned with the bars substantially perpendicular to the filaments, then the length of bars 12 should be at least about as great as the filament bundle.

The length of the bar arrangement 10 can be defined as the dimension perpendicular to the length of individual bars 12. The length of bar arrangement 10 should be at least as great as the length of the gas flow source. The length of the gas flow source is the length of the portion or portions of any apparatus which emits quenching gas. The number of bars 12 in the arrangement 10 may range from about 6–50 bars 12 per foot length of the bar arrangement 10, preferably about 8–25 bars 12 per foot length of bar arrangement 10, more preferably about 10–15 bars 12 per foot length of bar arrangement 10.

Figure 3:
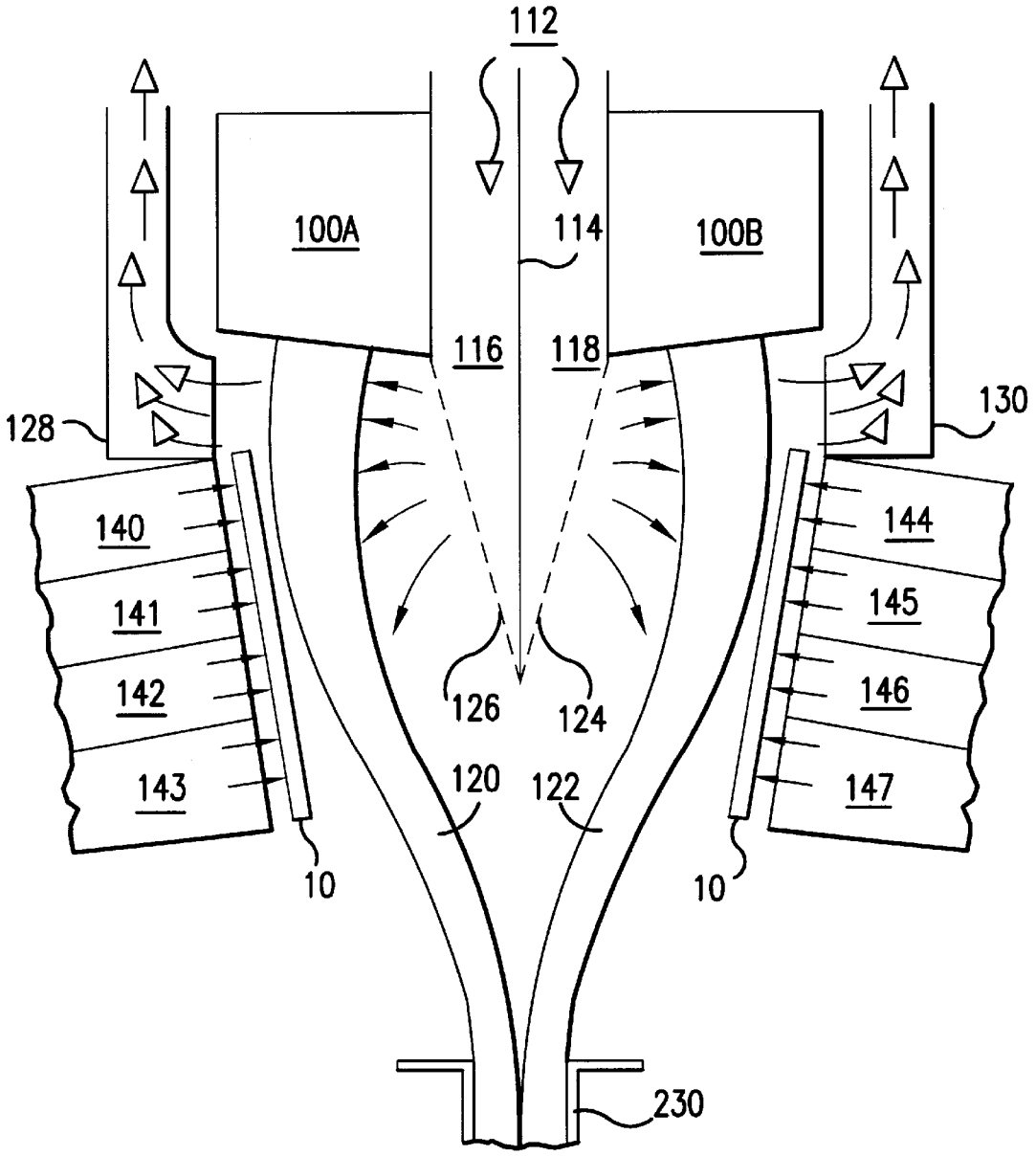
FIG. 3 schematically illustrates a dual spinplate arrangement used to make nonwoven filaments, including an interior and exterior gas cooling system, with turbulence-inducing bar arrangements incorporated into the exterior gas cooling system.

Referring to FIG. 3, an apparatus for extruding and quenching nonwoven filaments into a heteroconstituent and/or multilayered nonwoven web, using turbulent quenching gas, is schematically illustrated. Dual spinpacks 100A and 100B are arranged on opposite sides of a central conduit 112. A first bundle 120 of filaments is extruded from the spinpack 100A. A second bundle 122 of filaments, which may be the same or different from the first bundle 120, is extruded from the second spinpack 100B. The filament bundles 120 and 122 are quenched and gathered in the draw unit entry 230.

The first filament bundle 120 is quenched from the outside using air supplied from quench air supply zones 140, 141, 142 and 143, the surfaces of which may have conventional honeycomb configurations. In accordance with the invention, a first turbulence inducing bar arrangement 10 is provided between the quench air supply zones 140, 141, 142 and 143, and the filament bundle 120. The bar arrangement 10 splits the quench air into several interfering streams to cause turbulence, as illustrated by the arrows in FIG. 2. The bar arrangement 10 is preferably positioned with its bars perpendicular to the travel of the filament bundle 120.

The bar arrangement 10 should be as close as possible to the filament bundle 120, but not so close as to result in contact, so that the turbulent air flow generated by the arrangement 10 is sustained while contacting and penetrating the filament bundle 120. The bar arrangement 10 should be located between about 0.5–2.0 inches from the filament bundle 120, preferably about 0.5–1.0 inches, more preferably about 0.5 inches. If the filament bundle 120 curves inward as shown, it may not be practical to evenly space the bar arrangement 10 from the filament bundle 120. In this case, the distance between the bar arrangement 10 and filament bundle 120 should be determined and controlled at the end of the filament bundle nearest the spinpack, which is where the initial quenching occurs. Often, the distance is limited since the closest part of the filament bundle 120 may only be about 3.0–4.0 inches from the honeycomb surface which supplies the quench gas.

The flow velocity of quenching gas or air from the supply zones 140–143 should be conventional. Generally, the flow velocity of supply gas should range from about 50–500 feet per minute, preferably about 100–400 feet per minute, more preferably about 200–300 feet per minute. The temperature of the quench air may also be controlled to determine desired filament properties. For polypropylene spunbond filaments, the quench air may range from about 5–25° C., for example.

The second filament bundle 122 is quenched from the outside using air supplied from quench air supply zones 144, 145, 146 and 147. A second turbulence inducing bar arrangement 10 is provided between the quench air supply zones 144, 145, 146 and 147, and the filament bundle 122. The distances, air flow rates, and temperatures given above are equally applicable to the second group of quench air supply zones, the second bar arrangement 10, and the second filament bundle 122.

As shown, spinpacks 100A and 100B may be arranged on opposite sides of conduit 112. Additional quench air may be supplied through duct 112, downward between the spinplates 100 in a single stream (or zone), to help quench the interior side of the filament bundles 120 and 122. Duct 112 may advantageously be divided by divider 114 into supply zones 116, 118 which directs quench fluid through bundles 120, 122 respectively. Perforated plates or screens 124, 126 may be provided to control the fluid flow and increase its uniformity. Optionally, turbulence-inducing bar arrangements may be provided between duct 112 and filament bundles 120 and 122, to increase the turbulence of the interior quench air as well. Fume exhaust ducts 128, 130 are disposed on the opposite sides of bundles 120, 122 to receive a portion of the quench fluid. The rest of the quench fluid is drawn toward filament bundles and carries or is carried by them toward the fiber draw zone 230.

The spinpacks 100A and 100B may be used to extrude nonwoven filaments of any kind including without limitation spunbond filaments, meltblown (e.g., microfiber) filaments, and combinations thereof. The filaments from the two spinpacks may be of the same or different type, and the same or different composition. Polymers suitable for use in the filaments include without limitation polyethylene, polypropylene, polyamides, polyesters, copolymers of ethylene and propylene, copolymers of ethylene or propylene with a $C_4$–$C_{20}$ alpha-olefm, terpolymers of ethylene with propylene and a $C_4$–$C_{20}$ alpha-olefin, ethylene vinyl acetate copolymers, propylene vinyl acetate copolymers, styrene-poly(ethylene-alpha-olefin)elastomers, polyurethanes, A-B block copolymers where A is formed of poly(vinyl arene) moieties such as polystyrene and B is an elastomeric midblock such as a conjugated diene or lower alkene, polyethers, polyether esters, polyacrylates, ethylene alkyl acrylates, polyisobutylene, polybutadiene, isobutylene-isoprene copolymers and combinations of any of the foregoing. The filaments may be monocomponent, conjugate, bicomponent, or blends of polymers.

The filament groups 120 and 122 may also be varieties of bicomponent filaments, or a combination of monocomponent and bicomponent filaments. Different varieties of bicomponent filaments include those polymeric filaments having at least two distinct components, commonly known in the art as "sheath-core" filaments, "side-by-side" filaments, and "island-in-the-sea" filaments. Filaments containing three or more distinct polymer components are also included. Such filaments are generally spunbond, but can be formed using other processes. Monocomponent filaments, by comparison, include only one polymer.

The filament groups 120 and 122 may be spunbond, meltblown, or a combination thereof. Spunbond filaments are substantially continuous and generally have average fiber diameters of about 12–55 microns, frequently about 15–25 microns. Meltblown microfibers are generally discontinuous and have average fiber diameters up to about 10 microns, preferably about 2–6 microns.

The nonwoven filaments may be crimped or uncrimped. Crimped filaments are described, for instance, in U.S. Pat. No. 3,341,394, issued to Kinney. Crimped filaments may have less than 30 crimps per inch, or between 30–100 crimps per inch, or more than 100 crimps per inch, for example. The type A and type B filaments may differ as to their levels of crimping, or as to whether crimping is present.

It is also possible to have other materials blended with the polymer used to produce a nonwoven according to this invention like fluorocarbon chemicals to enhance chemical repellency which may be, for example, any of those taught in U.S. Pat. No. 5,178,931, fire retardants for increased resistance to fire and/or pigments to give each layer the same or distinct colors. Fire retardants and pigments for spunbond and meltblown thermoplastic polymers are known in the art and are frequently internal additives. A pigment, if used, is generally present in an amount less than 5 weight percent of the layer while other materials may be present in a cumulative amount less than 25 weight percent.

A further advantage of turbulent quench air is that it improves quenching efficiency by allowing the air to penetrate the filament bundle and carry away heat from the interior, instead of relying solely on heat transfer to the outer layer or curtain of the filament bundle, which the quench air first contacts. The invention is not limited to the dual spinpack arrangement, but is applicable to any number of spinpacks. The following Examples illustrate the increase in turbulence caused by a turbulence-inducing bar arrangement, in a single spinpack apparatus.

EXAMPLES

The following tests were performed to evaluate the turbulence-inducing performance of a bar arrangement constructed from parallel wooden bars, versus two other structures. In each case, the structure was placed between an air supply source and a filament bundle being quenched. The structures evaluated were as follows.

Example 1

For Example 1, no turbulence-enhancing structure was installed between the quench air supply and the filament bundle.

Example 2

For Example 2, a large mesh screen was used having a 74.8% open area and including one mesh opening per linear inch. The wire diameter was 0.135 inch.

Example 3

For Example 3, a smaller mesh screen was used having a 57.8% open area and including two mesh openings per linear inch. The wire diameter was 0.120 inch.

Example 4

For Example 4, a horizontal array of wooden bars, configured as shown in FIG. 1, was used. The bars were 0.625 inches in diameter and were spaced 1.25 inches apart at their centers. The open area was 50%.

A single spinpack was operated at standard conditions. Fibers were spun from a blend of 98% by weight polypropylene and 2% by weight titanium dioxide. Fiber deniers ranged from about 1.8–2.2 deniers per filament. The spinpack temperature was set at 440° F.

The quenching air supply apparatus included three zones, arranged in sequence. Quench air velocities were set at about 250 feet per minute for the purpose of comparing turbulence, and from 120–180 feet per minute for the purpose of comparing cooling efficiencies for the structures.

To compare the turbulence-inducing effect of the tested structures, each turbulence-enhancing structure was positioned about 2 inches away from the quench air supply apparatus. There was no extrusion of polymer through the spinnerette during the measurements of turbulence. Turbulence was measured about 3 inches away from the air supply apparatus (i.e., just downstream from the turbulence enhancing structure) in the first and third quenching zones. For Example 1 (no turbulence enhancing structure), the turbulence was measured about 5 inches from the air supply apparatus. Each quenching zone was 28 inches long (top to bottom), and turbulence was measured at zero, 7, 14, 21 and 28 inches.

To measure turbulence, a hot wire anemometer was used. The instrument included a probe, a major signal processing unit that produces a mean voltage, and a volt meter used to supply an RMS (root mean square) voltage. The probe was positioned at the proper location in the flow of gas, and the mean voltage was measured. The RMS voltage was divided by the mean voltage, and the result was multiplied by 100% to obtain the percent turbulence intensity.

Figure 4A:
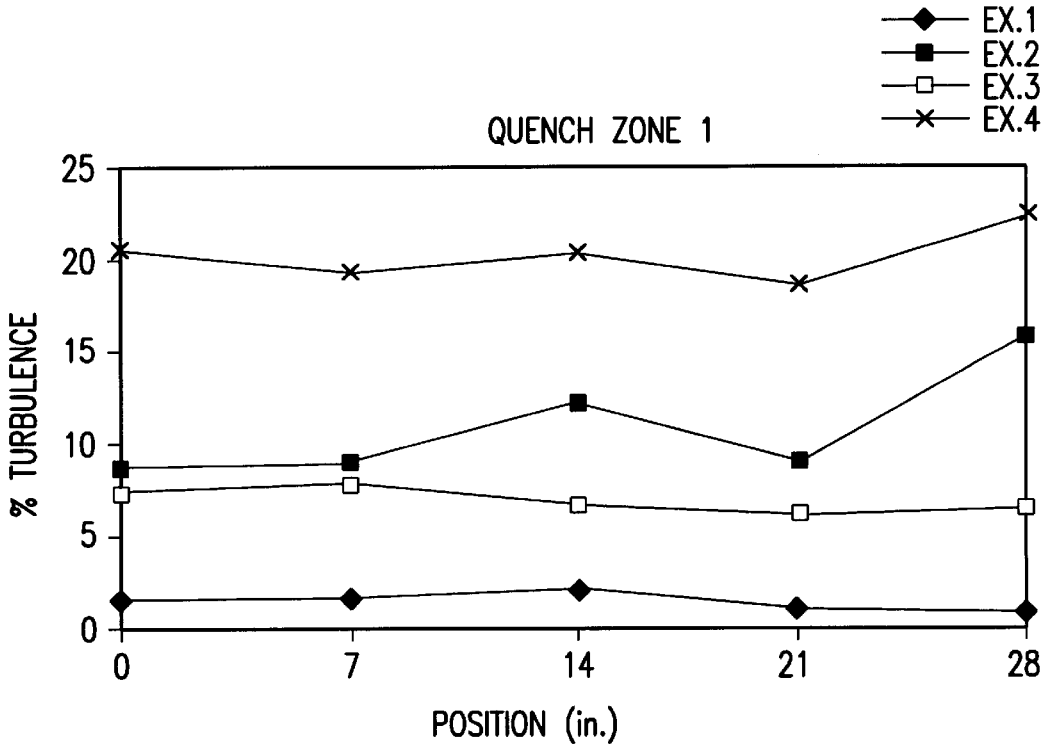
FIGS. 4(*a*) and 4(*b*) illustrate turbulence data generated for Examples 1–4, described below.
Figure 4B:
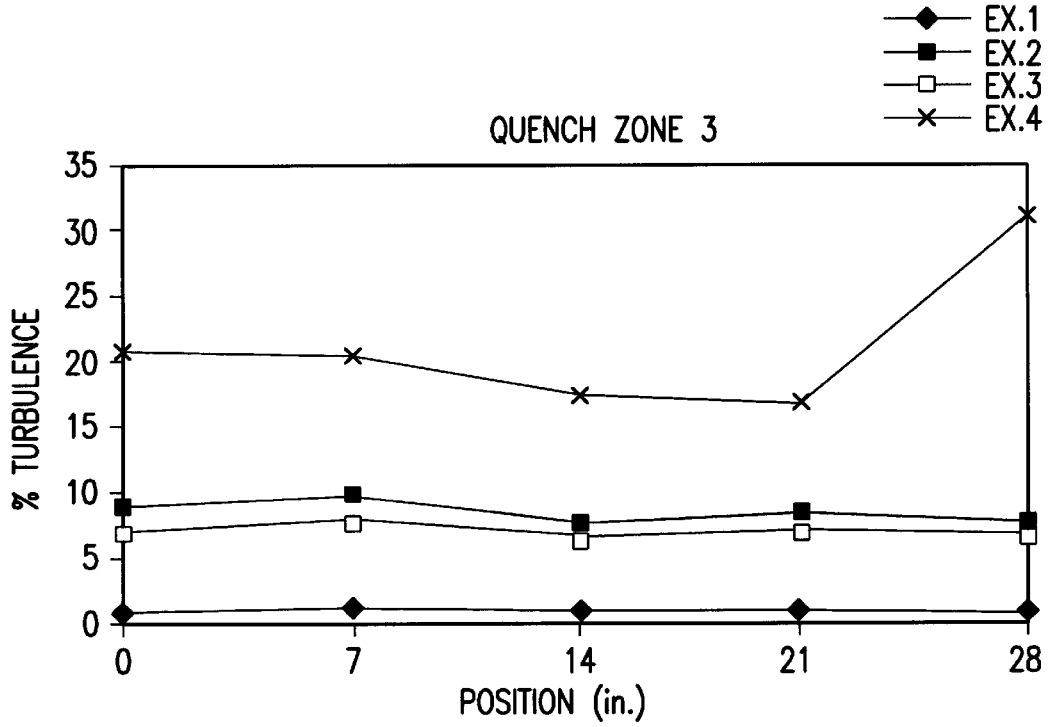

The results for the first and third zones are plotted in FIGS. 4(*a*) and 4(*b*). In both zones, the turbulence intensity measured without a turbulence enhancing structure (Example 1) was very low, at about 1–3%. When either of the two screens was installed (Examples 2 and 3), the turbulence intensity increased somewhat, to about 7–8% for the smaller mesh screen and about 9–15% for the larger mesh screen. When the turbulence-enhancing bar array of the invention (Example 4) was installed, the turbulence intensity increased substantially to about 18–32%.

To compare the cooling efficiencies of the tested structures, each turbulence-enhancing structure was placed about one inch from the quench air supply apparatus (due to limited space), and polymer filaments were extruded as described above. Flow rates for quench air were about 120 feet per minute for the first zone and about 180 feet per minute for the third zone. Cooling of filaments was measured using two techniques. First, an INFRAMETRICS® infrared camera was used to measure the heat profile for each fiber bundle at the same region as it passed between the quench zones. Thermograms were obtained showing the heat profiles for regions of constant temperature. The camera was operated in temperature range 3, in the auto span mode. The maximum length of the heat profile was measured for each sample, and the results were compared. The results of this comparison are shown in FIG. 5.

Second, the mean filament deniers were measured for the different turbulence-enhancing structures. Higher deniers reflect more effective cooling, since the filament diameters will not stretch as much. The results of this comparison are shown in FIG. 6.

Figure 5:
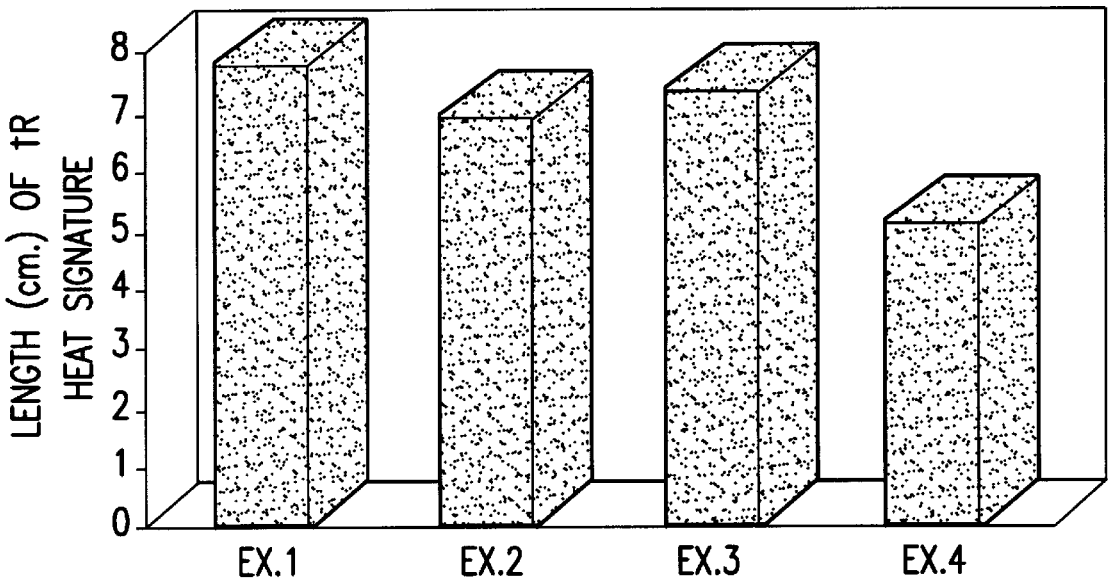
FIG. 5 is a plot of IR heat signature data generated for Examples 1–4.
Figure 6:
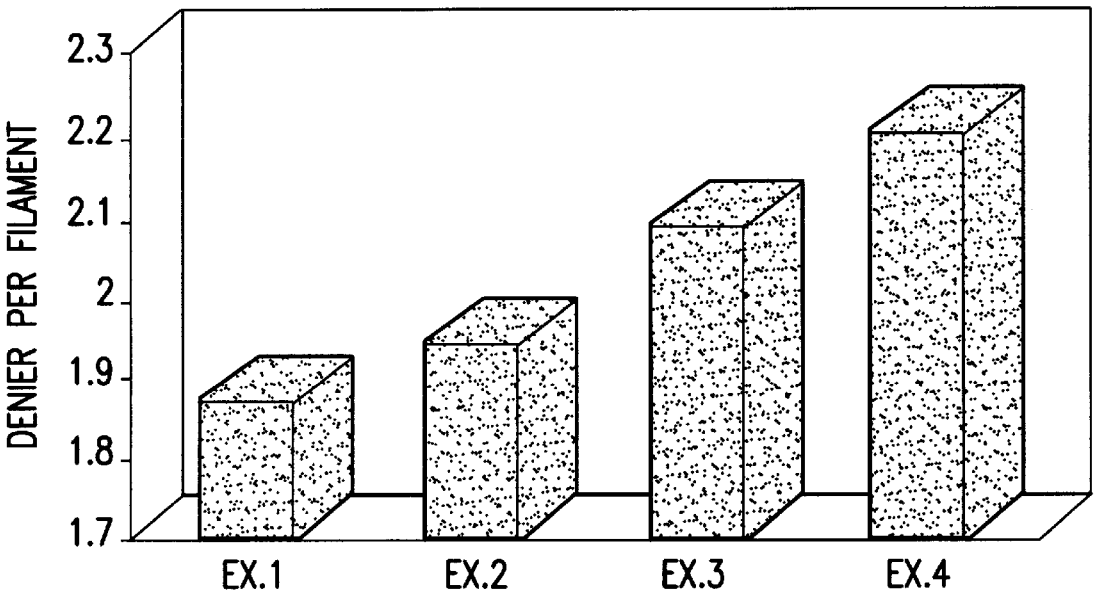
FIG. 6 is a plot of denier per filament generated for Examples 1–4.

FIGS. 5 and 6 both illustrate that bar arrangement (Example 4) achieved better cooling of the filament bundles than the mesh structures (Examples 2 and 3) or the control with no turbulence-enhancing structure (Example 1). The results illustrate that the turbulence-enhancing bar arrangement (Example 4) significantly improves the cooling efficiency by increasing the turbulence of quenching gas. The improved cooling is shown by the shorter heat signature (FIG. 5) and greater thickness per filament (FIG. 6) achieved with the turbulence enhancing bar arrangement.

Other variations of the turbulence-enhancing bar arrangement shown in FIG. 1 are also deemed to be within the scope of the invention. For instance, the generally horizontal bars 12 are not limited to the circular cross-section (illustrated in FIG. 2). The bars may have any cross-sectional shape including without limitation triangles, rectangles, ellipses, clovers, diamonds, trapezoids and parallelpipeds. The size spacing between the bars is the most important factor in inducing turbulence, for the reasons explained above. It is also possible to have cross-bars intersecting the bars, provided that the distance between the cross-bars is at least as great as the minimum spacing between the bars. Preferably, any cross-bars are smaller and further apart than the bars so as not to significantly interfere with the turbulence-enhancing effects of the bars. More preferably, there are no cross-bars intersecting the generally horizontal bars, except for the side bars 14 at the ends (FIG. 1).

While the embodiments of the invention disclosed herein are presently considered preferred, various modifications and improvements can be made without departing from the spirit and scope of the invention. The scope of the invention is indicated by the appended claims, and all changes that fall within the meaning and range of equivalents are intended to be embraced therein.

We claim:

1. A method of quenching nonwoven filaments, comprising the steps of:

extruding a group of nonwoven filaments from a spinnerette into a path;

passing a quenching gas through a turbulence-inducing bar arrangement in communication with the path, the turbulence-inducing bar arrangement including a plurality of spaced-apart basis; and quenching the nonwoven filaments by applying the quenching gas to the group of nonwoven filaments under turbulent flow conditions.

2. The method of claim 1, wherein the quenching gas applied to the filaments has a turbulence intensity of at least 5%.

3. The method of claim 1, wherein the quenching gas applied to the filaments has a turbulence intensity of at least 10%.

4. The method of claim 1, wherein the quenching gas applied to the filaments has a turbulence intensity of at least 20%.

5. The method of claim 1, wherein the quenching gas comprises air.

6. The method of claim 1, wherein the bars are substantially parallel to each other.

7. The method of claim 1, wherein the bars are substantially perpendicular to the group of filaments being extruded.

8. The method of claim 1, wherein the quenching gas is supplied at a velocity of about 50–500 feet per minute.

9. The method of claim 8, wherein the flow velocity is about 100–400 feet per minute.

10. The method of claim 8, wherein the flow velocity is about 200–300 feet per minute.

11. An apparatus for producing quenched nonwoven filaments, comprising:

a spinnerette for extruding a group of nonwoven filaments in a path;

a supply apparatus communicating with the path for applying quenching gas to the group of nonwoven filaments following extrusion; and a turbulence-inducing bar arrangement disposed between the supply apparatus and the path for increasing the turbulence of the quenching gas applied to the group of nonwoven filaments;

the bar arrangement including a plurality of turbulence inducing bars and spaces between the bars.

12. The apparatus of claim 11, wherein the bar arrangement occupies a planar area, the bars occupy about 20–80% of the planar area, and the spaces between the bars occupy about 20–80% of the planar area.

13. The apparatus of claim 12, wherein the bars occupy about 30–70% of the planar area, and the spaces between the bars occupy about 30–70% of the planar area.

14. The apparatus of claim 12, wherein the bars occupy about 40–60% of the planar area, and the spaces between the bars occupy about 40–60% of the planar area.

15. The apparatus of claim 11, wherein the bars have an average width of about 0.125–1.00 inch.

16. The apparatus of claim 11, wherein the bars have an average width of about 0.25–0.75 inch.

17. The apparatus of claim 11, wherein the bars have an average width of about 0.40–0.60 inch.

18. The apparatus of claim 11, wherein the bars are present at about 6–50 bars per foot length of the bar arrangement.

19. The apparatus of claim 11, wherein the bars are present at about 8–25 bars per foot length of the bar arrangement.

20. The apparatus of claim 11, wherein the bars are present at about 10–15 bars per foot length of the bar arrangement.

21. The apparatus of claim 11, wherein the bars are substantially parallel to each other.

22. The apparatus of claim 11, wherein the bars are substantially horizontal.

23. The apparatus of claim 11, wherein the bars are substantially perpendicular to the path.

24. The apparatus of claim 11, wherein the bars have cross-sectional shapes selected from the group consisting of circles, triangles, rectangles, ellipses, clovers, diamonds, trapezoids and parallelpipeds.

25. A quenching apparatus, comprising:

a supply apparatus for generating a stream of quenching gas; and a turbulence-inducing bar arrangement disposed in the stream of quenching gas;

the bar arrangement including a plurality of substantially parallel turbulence-inducing bars and open spaces between the bars;

the bar arrangement further including a pair of cross-bars intersecting and supporting the substantially parallel bars but otherwise substantially devoid of cross-bars.

* * * * *